US007672433B2

(12) United States Patent
Zhong et al.

(10) Patent No.: US 7,672,433 B2
(45) Date of Patent: Mar. 2, 2010

(54) APPARATUS FOR INCREASING RADIATIVE HEAT TRANSFER IN AN X-RAY TUBE AND METHOD OF MAKING SAME

(75) Inventors: Dalong Zhong, Niskayuna, NY (US); Dennis M. Gray, Delanson, NY (US); Michael Hebert, Muskego, WI (US); Don Mark Lipkin, Niskayuna, NY (US); Thomas Raber, Schenectady, NY (US); Gregory Alan Steinlage, Hartland, WI (US); Thomas C. Tiearney, Waukesha, WI (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 12/122,279

(22) Filed: May 16, 2008

(65) Prior Publication Data

US 2009/0285363 A1 Nov. 19, 2009

(51) Int. Cl.
*H01J 35/00* (2006.01)

(52) U.S. Cl. ..... 378/129

(58) Field of Classification Search ..... 378/119, 378/121, 122, 125–129, 141, 144
See application file for complete search history.

(56) References Cited

U.S. PATENT DOCUMENTS

| | | | | |
|---|---|---|---|---|
| 4,029,828 | A | 6/1977 | Bildstein et al. | |
| 4,132,916 | A | 1/1979 | Hueschen et al. | |
| 4,327,305 | A | 4/1982 | Weber | |
| 4,600,659 | A | 7/1986 | Hong et al. | |
| 4,637,042 | A * | 1/1987 | Braun | 378/143 |
| 4,870,672 | A | 9/1989 | Lindberg | |
| 4,953,190 | A | 8/1990 | Kukoleck et al. | |
| 4,975,621 | A | 12/1990 | Fukubayashi et al. | |
| 5,150,397 | A | 9/1992 | Randzaao | |
| 5,159,619 | A * | 10/1992 | Benz et al. | 378/143 |
| 5,264,801 | A | 11/1993 | DeCou, Jr. et al. | |
| 6,118,853 | A * | 9/2000 | Hansen et al. | 378/143 |
| 6,456,692 | B1 * | 9/2002 | Smith | 378/129 |
| 6,554,179 | B2 | 4/2003 | Horner et al. | |
| 6,713,774 | B2 | 3/2004 | DeSteese et al. | |
| 7,194,066 | B2 * | 3/2007 | Tiearney et al. | 378/143 |

FOREIGN PATENT DOCUMENTS

WO WO0227752 A1 4/2002

* cited by examiner

*Primary Examiner*—Jurie Yun
(74) *Attorney, Agent, or Firm*—Scott J. Asmus

(57) ABSTRACT

A target assembly for generating x-rays includes a target substrate, and an emissive coating applied to a portion of the target substrate, the emissive coating comprising one or more of a carbide and a carbonitride.

25 Claims, 4 Drawing Sheets

APPARATUS FOR INCREASING RADIATIVE HEAT TRANSFER IN AN X-RAY TUBE AND METHOD OF MAKING SAME

BACKGROUND OF THE INVENTION

The invention relates generally to x-ray tubes and, more particularly, to a high emissive coating on a target face and/or a target shaft of an x-ray tube.

X-ray systems typically include an x-ray tube, a detector, and a bearing assembly to support the x-ray tube and the detector. In operation, an imaging table, on which an object is positioned, is located between the x-ray tube and the detector. The x-ray tube typically emits radiation, such as x-rays, toward the object. The radiation typically passes through the object on the imaging table and impinges on the detector. As radiation passes through the object, internal structures of the object cause spatial variances in the radiation received at the detector. The detector then transmits data received, and the system translates the radiation variances into an image, which may be used to evaluate the internal structure of the object. One skilled in the art will recognize that the object may include, but is not limited to, a patient in a medical imaging procedure and an inanimate object as in, for instance, a package in a computed tomography (CT) package scanner.

X-ray tubes include an anode structure comprising a target onto which the electron beam impinges and from which x-rays are generated. An x-ray tube cathode provides a focused electron beam that is accelerated across a cathode-to-anode vacuum gap and produces x-rays upon impact with the anode target. Because of the high temperatures generated when the electron beam strikes the target, the anode assembly is typically rotated at high rotational speed for the purpose of distributing heat generated at a focal spot. The anode is typically rotated by an induction motor having a cylindrical rotor built into a cantilevered axle that supports a disc-shaped anode target and an iron stator structure with copper windings that surrounds an elongated neck of the x-ray tube. The rotor of the rotating anode assembly is driven by the stator.

Newer generation x-ray tubes have increasing demands for providing higher peak power. Higher peak power, though, results in higher peak temperatures occurring in the target assembly, particularly at the target "track," or the point of electron beam impact on the target. Thus, for increased peak power applied, there are life and reliability issues with respect to the target.

Emissive coatings may be applied to x-ray tube targets in order to enhance radiative heat transfer and reduce the operating temperature of the components therein, such as the target and the bearing assembly. However, such coatings are typically based on oxides, such as mixtures of $ZrO_2$—$TiO_2$—$Al_2O_3$, which tend be unstable and outgas at, for instance, 1200° C. or greater. Typically, the outgas includes carbon monoxide (CO), which results from poor chemical stability of oxide constituents (e.g., $TiO_2$) with the reducing components of the target substrate (e.g., $Mo_2C$ phase in TZM-Mo) at its operating temperature. CO and other outgas products compromise the high-vacuum environment of the x-ray tube, making such reaction products undesirable.

Therefore, it would be desirable to have a method and apparatus to improve thermal performance and reliability of an x-ray tube target and bearing while reducing outgas emissions.

BRIEF DESCRIPTION OF THE INVENTION

The invention provides an apparatus for improving thermal performance of an x-ray tube target that overcomes the aforementioned drawbacks.

According to one aspect of the invention, a target assembly for generating x-rays includes a target substrate, and an emissive coating applied to a portion of the target substrate, the emissive coating comprising one or more of a carbide and a carbonitride.

In accordance with another aspect of the invention, a method of fabricating an x-ray tube target assembly includes forming a target substrate that includes Mo and alloys there of, and forming an emissive coating on the substrate, wherein the emissive coating includes one or more of a carbide and a carbonitride.

Yet another aspect of the invention includes an imaging system having an x-ray detector and an x-ray emission source. The x-ray source includes a cathode and an anode. The anode includes a target base material, and an emissive coating attached to the target base material having a molecular compound that includes one or more of a carbide and a carbonitride.

Various other features and advantages of the invention will be made apparent from the following detailed description and the drawings.

BRIEF DESCRIPTION OF THE DRAWINGS

The drawings illustrate one preferred embodiment presently contemplated for carrying out the invention.

In the drawings.

DETAILED DESCRIPTION OF THE PREFERRED EMBODIMENT

Figure 1:
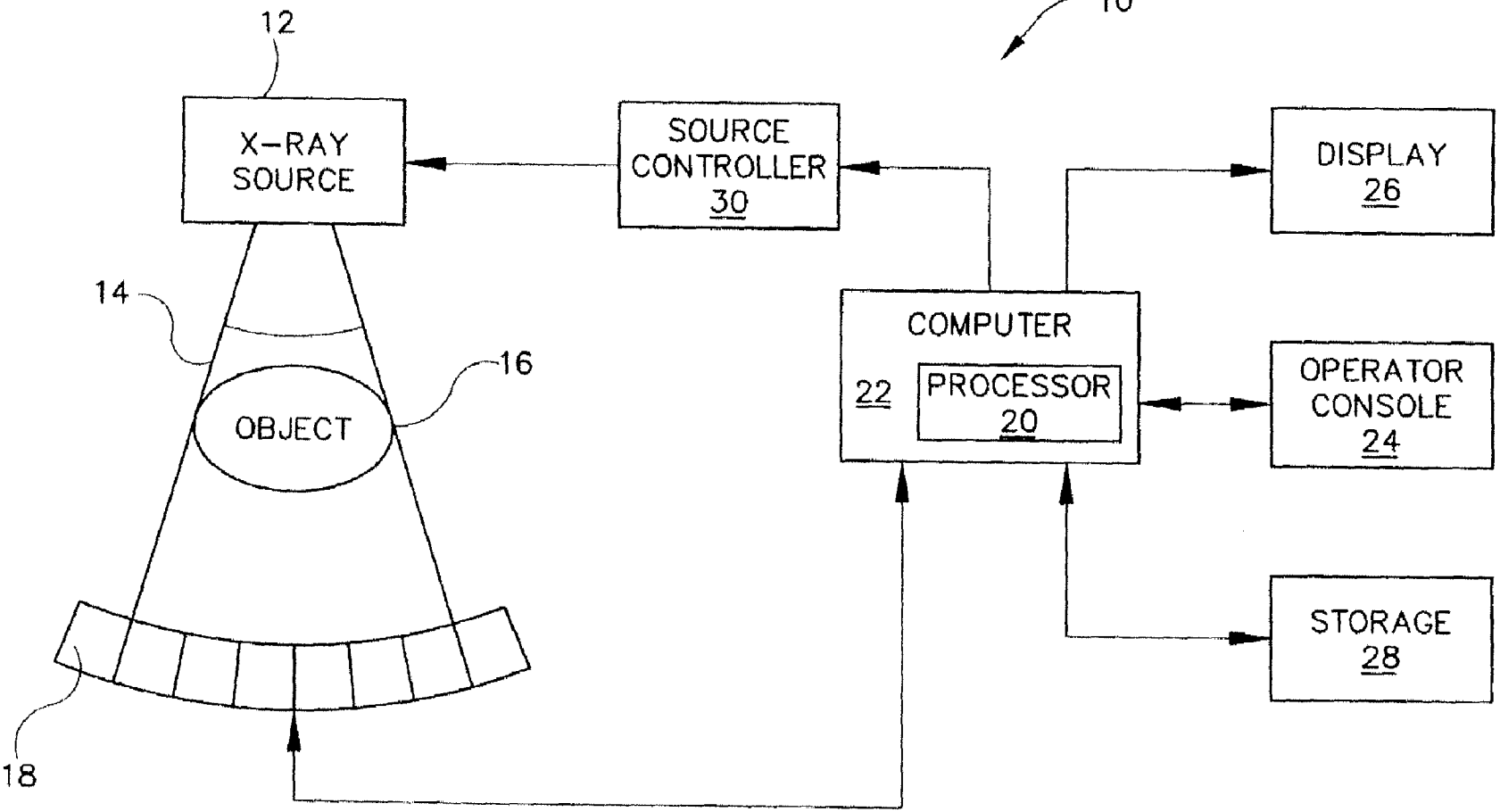
FIG. 1 is a block diagram of an imaging system that can benefit from incorporation of an embodiment of the invention.

FIG. 1 is a block diagram of an embodiment of an imaging system 10 designed both to acquire original image data and to process the image data for display and/or analysis in accordance with the invention. It will be appreciated by those skilled in the art that the invention is applicable to numerous industrial and medical imaging systems implementing an x-ray tube, such as x-ray or mammography systems. Other imaging systems such as computed tomography systems and digital radiography systems, which acquire three-dimensional image data for a volume, also benefit from the invention. The following discussion of x-ray system 10 is merely an example of one such implementation and is not intended to be limiting in terms of modality.

As shown in FIG. 1, x-ray system 10 includes an x-ray source 12 configured to project a beam of x-rays 14 through an object 16. Object 16 may include a human subject, pieces of baggage, or other objects desired to be scanned. X-ray source 12 may be a conventional x-ray tube producing x-rays having a spectrum of energies that range, typically, from 30 keV to 200 keV. The x-rays 14 pass through object 16 and, after being attenuated by the object 16, impinge upon a detector 18. Each detector in detector 18 produces an analog electrical signal that represents the intensity of an impinging x-ray beam, and hence the attenuated beam, as it passes through the object 16. In one embodiment, detector 18 is a scintillation based detector, however, it is also envisioned that direct-conversion type detectors (e.g., CZT detectors, etc.) may also be implemented.

A processor 20 receives the analog electrical signals from the detector 18 and generates an image corresponding to the object 16 being scanned. A computer 22 communicates with processor 20 to enable an operator, using operator console 24, to control the scanning parameters and to view the generated image. That is, operator console 24 includes some form of operator interface, such as a keyboard, mouse, voice activated controller, or any other suitable input apparatus that allows an operator to control the x-ray system 10 and view the reconstructed image or other data from computer 22 on a display unit 26. Additionally, console 24 allows an operator to store the generated image in a storage device 28 which may include hard drives, floppy discs, compact discs, etc. The operator may also use console 24 to provide commands and instructions to computer 22 for controlling a source controller 30 that provides power and timing signals to x-ray source 12.

Moreover, the invention will be described with respect to use in an x-ray tube. However, one skilled in the art will further appreciate that the invention is equally applicable for other systems that include a target used for the production of x-rays.

Figure 2:
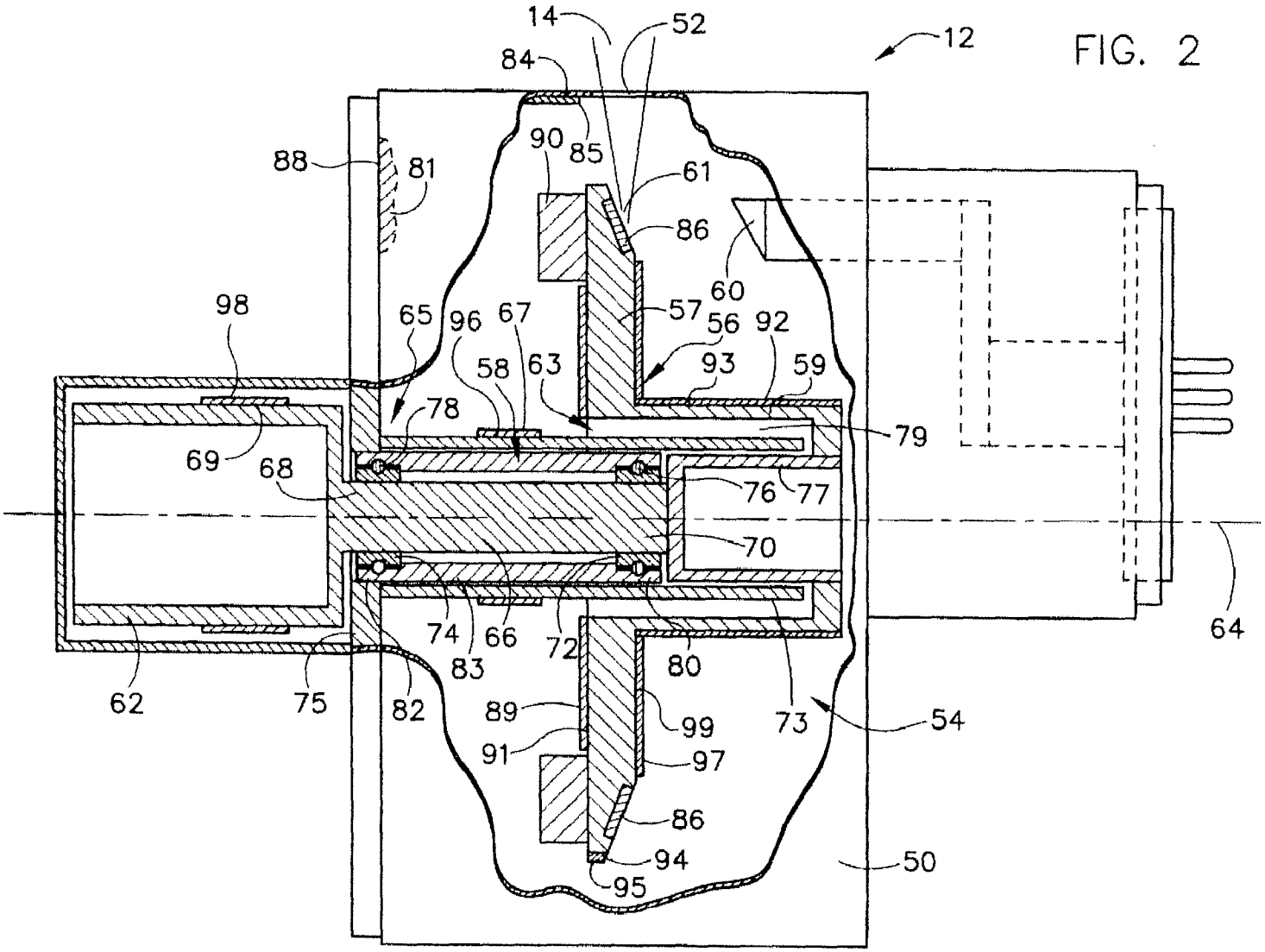
FIG. 2 is a cross-sectional view of an x-ray tube according to an embodiment of the invention and useable with the system illustrated in FIG. 1.

FIG. 2 illustrates a cross-sectional view of an x-ray tube 12 incorporating an embodiment of the invention. The x-ray tube 12 includes a frame or casing 50 having an x-ray window 52 formed therein. The frame 50 encloses a vacuum 54 and houses an anode or target assembly 56, a bearing cartridge 58, a cathode 60, and a rotor 62. The target assembly 56 includes a target substrate 57 having a target shaft 59 attached thereto. X-rays 14 are produced when high-speed electrons are decelerated when directed from the cathode 60 to the target substrate 57 via a potential difference therebetween of, for example, 60 thousand volts or more in the case of CT applications. The electrons impact a target track material 86 at focal point 61 and x-rays 14 emit therefrom. The x-rays 14 emit through the x-ray window 52 toward a detector array, such as detector 18 of FIG. 1. To avoid overheating the target track material 86 by the electrons, the target assembly 56 is rotated at a high rate of speed about a centerline 64 at, for example, 90-250 Hz.

The bearing cartridge 58 includes a front bearing assembly 63 and a rear bearing assembly 65. The bearing cartridge 58 further includes a center shaft 66 attached to the rotor 62 at a first end 68 of center shaft 66 and a bearing hub 77 attached at a second end 70 of center shaft 66. The front bearing assembly 63 includes a front inner race 72, a front outer race 80, and a plurality of front balls 76 that rollingly engage the front races 72, 80. The rear bearing assembly 65 includes a rear inner race 74, a rear outer race 82, and a plurality of rear balls 78 that rollingly engage the rear races 74, 82. Bearing cartridge 58 includes a stem 83 which is supported by the x-ray tube 12. A stator (not shown) is positioned radially external to and drives the rotor 62, which rotationally drives target assembly 56. In one embodiment, a receptor 73 is positioned to surround the stem 83 and is attached to the x-ray tube 12 at a back plate 75. The receptor 73 extends into a gap 79 formed between the target shaft 59 and the bearing hub 77.

The target track material 86 typically includes tungsten or an alloy of tungsten, and the target substrate 57 typically includes molybdenum or an alloy of molybdenum. A heat storage medium 90, such as graphite, may be used to sink and/or dissipate heat built-up near the focal point 61. One skilled in the art will recognize that the target track material 86 and the target substrate 57 may comprise the same material, which is known in the art as an all metal target.

In operation, as electrons impact focal point 61 and produce x-rays, heat generated therein causes the target substrate 57 to increase in temperature, thus causing the heat to transfer predominantly via radiative heat transfer to surrounding components such as, and primarily, frame 50. Heat generated in target substrate 57 also transfers conductively through target shaft 59 and bearing hub 77 to bearing cartridge 58 as well, leading to an increase in temperature of bearing cartridge 58.

Without an emissive coating or other surface modification, target substrate 57 may have an emissivity of, for instance, 0.18. As such, radiative heat transfer from the target assembly 56 may be limited, thus contributing to an increased operating temperature of the bearing cartridge 58 and other components of the target assembly 56. Thus, to reduce conductive heat transfer into bearing cartridge 58 and to increase the amount of radiative heat transfer to the surrounding components, an emissive coating 92 may be applied to an outer surface 93 of target shaft 59. An emissive coating 97, furthermore, may be applied to surface 99 of the target substrate 57 and an emissive coating 94 may also be applied to an outer circumference 95 of the target substrate 57. Furthermore, an emissive coating 89 may be applied to the surface 91 of the target substrate 57.

Furthermore, emissive coatings may be applied to other surfaces that are encompassed within frame 50 and typically radiatively exchange heat with the target assembly 56. For instance, emissive coating 85 may be applied to frame 50 at outer circumference surface 84 or an emissive coating 81 may be applied on axial surface 88. Additionally, an emissive coating 98 may be applied to surface 69 of rotor 62, or an emissive coating 67 may be applied to receptor 73 at surface 96. And, although the emissive coatings 67, 81, 84, 85, and 98, are illustrated over only a small portion of their respective surfaces, one skilled in the art will recognize that the emissive coatings 67, 81, 84, 85, and 98, like emissive coatings 89, 94, and 97, may be applied over the entire respective surfaces to which they are applied.

According to one embodiment of the invention, the emissive coatings 67, 81, 85, 89, 92, 94, 97, 98 are based on refractory carbides, carbonitrides, and borides of Groups 4, 5, and 6 elements (in modern IUPAC nomenclature) in the periodic table (e.g., TiC, ZrC, HfC, TaC, $Mo_2C$, $ZrB_2$, $HfB_2$, $TiC_xN_y$, $ZrC_xN_y$, and $HfC_xN_y$). In the case of a carbide, the emissive coatings 67, 81, 85, 89, 92, 94, 97, 98 may further include Mo. In another embodiment, the emissive coatings 67, 81, 85, 89, 92, 94, 97, 98 include boron carbide ($B_4C$). In still another embodiment, the emissive coatings 67, 81, 85, 89, 92, 94, 97, 98 are a combination of refractory carbides, carbonitrides, and borides with a stable oxide, including but not limited to $Al_2O_3$, $La_2O_3$, $Y_2O_3$, $ZrO_2$, and $HfO_2$. The emissive coatings 67, 81, 85, 89, 92, 94, 97, 98 may be applied by, for instance, processes that include chemical vapor deposition (CVD), physical vapor deposition (PVD), thermal/plasma spray, cold spray, reactive brazing, brazing, and cladding.

Figure 4:
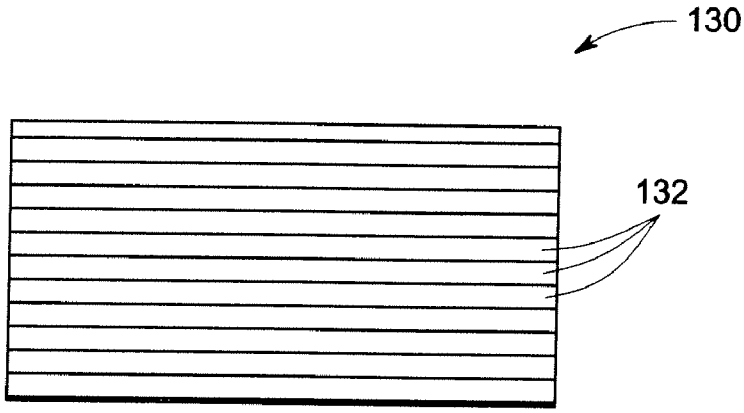
FIG. 4 illustrates a multilayered microstructure for one embodiment of the invention.
Figure 5:
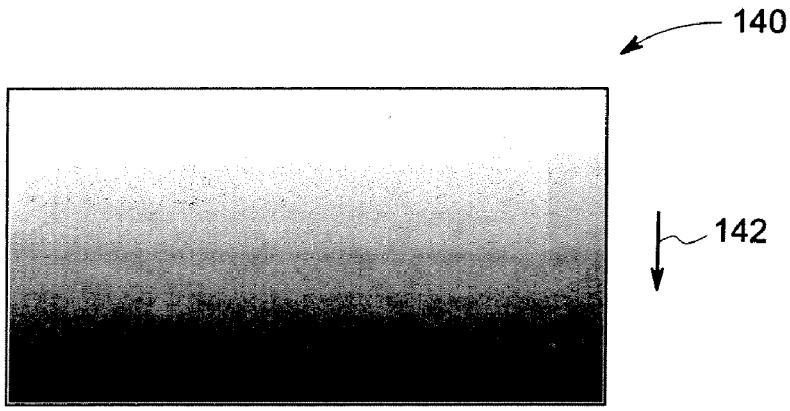
FIG. 5 illustrates a graded microstructure for one embodiment of the invention.
Figure 6:
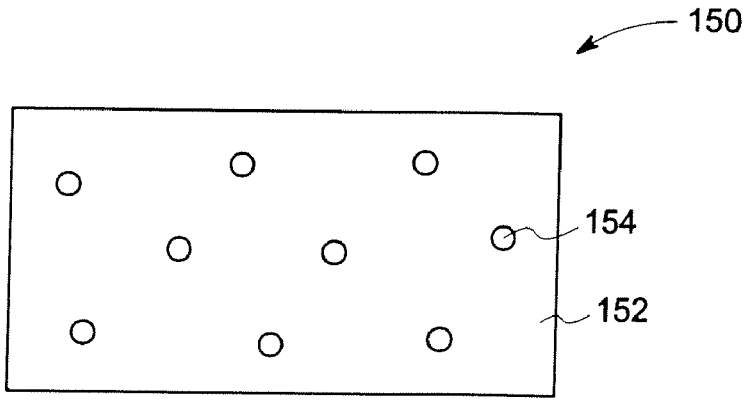
FIG. 6 illustrates a composite microstructure for one embodiment of the invention.

The emissive coatings 67, 81, 85, 89, 92, 94, 97, 98 may be single phase structures or multiphase structures. To enhance robustness of the coatings, such coatings may include multilayered, graded, and/or composite microstructures. Furthermore, in the case of a composite coating, the constituents may be non-oxides having high emissivity or a composite that includes at least one thermally emissive non-oxide (e.g., ZrC or TiC) in an oxide matrix (e.g. $Al_2O_3$, $La_2O_3$, $Y_2O_3$, $ZrO_2$ and $HfO_2$), which is stable with Mo alloys at high temperatures. Due to its favorable dielectric properties, such an oxide increases the effective emissive surface area, thus increasing radiative heat transfer therefrom. FIGS. 4, 5, and 6 show non-limiting examples of a multilayered, a graded, and a composite microstructure from which emissive coatings of type 67, 81, 85, 89, 92, 94, 97, or 98 may be fabricated FIG. 4 shows, in schematic cross sectional view 130, a multilayered microstructure including multiple layers 132. FIG. 5 shows, in schematic cross sectional view 140, a graded microstructure including a gradation of a physical property such as density, or composition, along, for instance, a thickness direction 142. FIG. 5 shows, in schematic cross sectional view 150, a composite microstructure including for instance two phases 152 and 154.

In order to enhance long-term stability, thin diffusion barrier may be applied between the emissive coatings and their respective surfaces on which they are applied. Thus, the emissive coatings 67, 81, 85, 89, 92, 94, 97, 98 may include a diffusion barrier layer positioned between the emissive coatings 67, 81, 85, 89, 92, 94, 97, 98 and their respective surfaces 96, 88, 84, 91, 93, 95, 99, 69. According to embodiments of the invention, the diffusion barrier layer may include nitrides and carbonitrides of Ti, Zr, and Hf, and preferred candidates include TiN, ZrN, HfN, TiCN, ZrCN, and HfCN.

Thus, according to embodiments of the invention described herein, with an increased emissivity on surfaces 96, 88, 84, 91, 93, 95, 99, 69, an increase in heat transferred out of target shaft 59 and out of target substrate 57 via radiation will thus reduce heat transferred out of target shaft 59 via conduction. As a consequence, the operating temperature of the target assembly 56 (to include the target shaft 59, the bearing hub 77, and the bearing cartridge 58) may be reduced.

Figure 3:
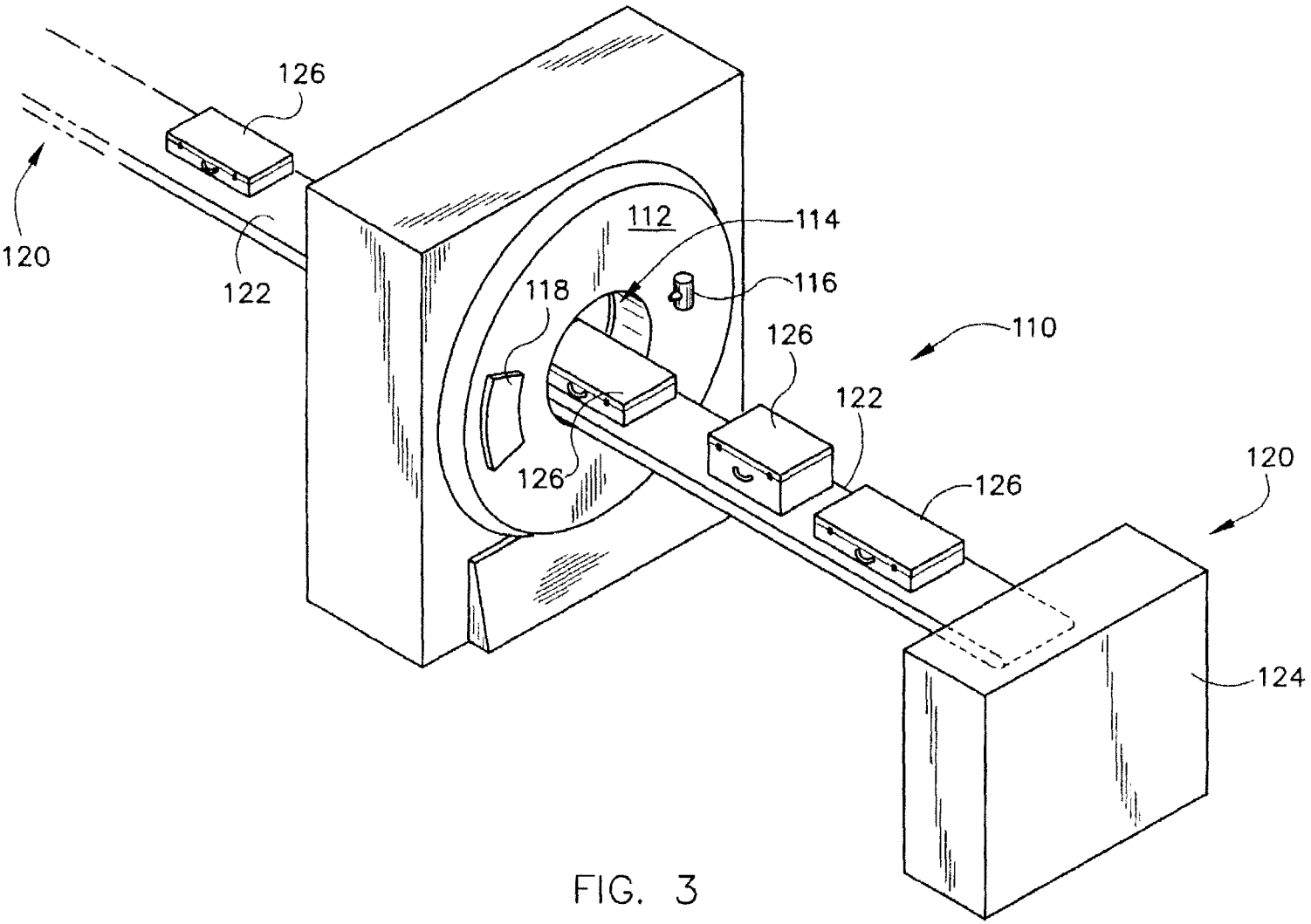
FIG. 3 is a pictorial view of a CT system for use with a non-invasive package inspection system that can benefit from incorporation of an embodiment of the invention.

FIG. 3 is a pictorial view of a CT system for use with a non-invasive package inspection system. Package/baggage inspection system 100 includes a rotatable gantry 102 having an opening 104 therein through which packages or pieces of baggage may pass. The rotatable gantry 102 houses a high frequency electromagnetic energy source 106 as well as a detector assembly 108 having scintillator arrays comprised of scintillator cells. A conveyor system 110 is also provided and includes a conveyor belt 112 supported by structure 114 to automatically and continuously pass packages or baggage pieces 116 through opening 104 to be scanned. Objects 116 are fed through opening 104 by conveyor belt 112, imaging data is then acquired, and the conveyor belt 112 removes the packages 116 from opening 104 in a controlled and continuous manner. As a result, postal inspectors, baggage handlers, and other security personnel may non-invasively inspect the contents of packages 116 for explosives, knives, guns, contraband, etc.

According to one embodiment of the invention, a target assembly for generating x-rays includes a target substrate, and an emissive coating applied to a portion of the target substrate, the emissive coating comprising one or more of a carbide and a carbonitride.

In accordance with another embodiment of the invention, a method of fabricating an x-ray tube target assembly includes forming a target substrate that includes Mo and alloys there of, and forming an emissive coating on the substrate, wherein the emissive coating includes one or more of a carbide and a carbonitride.

Yet another embodiment of the invention includes an imaging system having an x-ray detector and an x-ray emission source. The x-ray source includes a cathode and an anode. The anode includes an emissive coating attached to the target base material having a molecular compound that includes one or more of a carbide and a carbonitride.

The invention has been described in terms of the preferred embodiment, and it is recognized that equivalents, alternatives, and modifications, aside from those expressly stated, are possible and within the scope of the appending claims.

What is claimed is:

1. An x-ray target assembly for generating x-rays comprising:

a target substrate; and an emissive coating applied to a portion of the target substrate, the emissive coating comprising one or more of a carbide and one or more of a carbonitride.

2. The target of claim 1 wherein the emissive coating has an emissivity greater than 0.6.

3. The target of claim 1 wherein the emissive coating further comprises a stable oxide.

4. The target of claim 3 wherein the stable oxide comprises one of $Al_2O_3$, $La_2O_3$, $Y_2O_3$, $ZrO_2$, and $HfO_2$.

5. The target of claim 1 wherein the emissive coating further includes Mo.

6. The target of claim 1 wherein the emissive coating includes one of a multilayered, a graded, and a composite microstructure.

7. The target of claim 1 wherein the emissive coating is one of a single phase material and a multiphase material.

8. The target of claim 1 wherein the emissive coating is applied via one of a chemical vapor deposition (CVD) process, a physical vapor deposition (PVD) process, a thermal/plasma spray process, a cold spray process, a reactive brazing process, a brazing process and a cladding process.

9. The target of claim 1 wherein the emissive coating includes at least one of a Group 4 element, a Group 5 element, a Group 6 element, and boron.

10. The target of claim 1 wherein the emissive coating includes boron carbide ($B_4C$).

11. The target of claim 1 wherein the emissive coating includes at least one of TiC, ZrC, HfC, TaC, $Mo_2C$, $ZrB_2$, $HfB_2$, $TiC_xN_y$, $ZrC_xN_y$, and $HfC_xN_y$.

12. The target of claim 1 wherein the target substrate includes a target face and an outer rim, and wherein the target assembly further comprises a shaft attached to the target substrate, and wherein the emissive coating is applied to one of the target face, the outer rim, and the shaft.

13. The target of claim 1 wherein the target assembly further comprises a diffusion barrier positioned between the emissive and the target substrate.

14. The target of claim 13 wherein the diffusion barrier is one of a nitride and a carbonitride of Ti, Zr, and Hf.

15. A method of fabricating an x-ray tube target assembly comprising:

forming a target substrate that includes Mo and alloys there of; and forming an emissive coating on the substrate, wherein the emissive coating includes one or more of a carbide and one or more of a carbonitride.

16. The method of claim 15 wherein forming an emissive coating includes forming an emissive coating on the substrate having an emissivity greater than 0.6.

17. The method of claim 15 further comprising forming a diffusion barrier between the emissive coating and the substrate, wherein the diffusion barrier is one of a nitride and a carbonitride of Ti, Zr, and Hf.

18. The method of claim 15 wherein the emissive coating includes at least one of a Group IV element, a Group V element, a Group VI element, and boron.

19. The method of claim 15 wherein the emissive coating includes boron carbide ($B_4C$).

20. The method of claim 15 wherein forming an emissive coating on the substrate comprises forming the emissive coating on the substrate via one of a chemical vapor deposition (CVD) process, a physical vapor deposition (PVD) process, a thermal/plasma spray process, a cold spray process, a reactive brazing process, a brazing process and a cladding process.

21. An imaging system comprising:

an x-ray detector; and an x-ray emission source having:

a cathode; and an anode, the anode comprising:

a target base material; and an emissive coating attached to the target base material having a molecular compound that includes one or more of a carbide and one or more of a carbonitride.

22. The imaging system of claim 21 wherein the emissive coating has an emissivity greater than 0.6.

23. The imaging system of claim 21 wherein the anode further comprises a diffusion barrier positioned between the emissive coating and the target base material, wherein the diffusion barrier is one of a nitride and a carbonitride of Ti, Zr, and Hf.

24. The imaging system of claim 21 wherein the emissive coating includes at least one of a Group IV element, a Group V element, a Group VI element, and boron.

25. The imaging system of claim 21 wherein the x-ray emission source further comprises one of a frame, a rotor, and a receptor, and wherein the emissive coating is attached to thereupon.

* * * * *

UNITED STATES PATENT AND TRADEMARK OFFICE

CERTIFICATE OF CORRECTION

PATENT NO. : 7,672,433 B2
APPLICATION NO. : 12/122279
DATED : March 2, 2010
INVENTOR(S) : Zhong et al.

It is certified that error appears in the above-identified patent and that said Letters Patent is hereby corrected as shown below:

In Column 5, Line 18, delete "fabricated" and insert -- fabricated. --, therefor.

In Column 6, Line 58, in Claim 13, after "emissive" insert -- coating --.

Signed and Sealed this

Fifteenth Day of June, 2010

David J. Kappos

David J. Kappos
*Director of the United States Patent and Trademark Office*